United States Patent [19]

Radek

[11] 4,343,415

[45] Aug. 10, 1982

[54] NAPKIN DISPENSER

[75] Inventor: John R. Radek, Hinsdale, Ill.

[73] Assignee: Ready Metal Manufacturing Company, Chicago, Ill.

[21] Appl. No.: 186,396

[22] Filed: Sep. 11, 1980

Related U.S. Application Data

[63] Continuation of Ser. No. 76,830, Sep. 19, 1979, abandoned.

[51] Int. Cl.[3] ..... B65H 1/12

[52] U.S. Cl. ..... 221/59

[58] Field of Search ..... 221/63, 59, 60, 45, 221/226, 279, 46; 312/61, 71

[56] References Cited

U.S. PATENT DOCUMENTS

| | | | |
|---|---|---|---|
| 855,653 | 6/1907 | Muller | 221/59 X |
| 3,370,748 | 2/1968 | Koerper et al. | 221/59 |
| 3,806,218 | 4/1974 | Cummings | 312/71 |

*Primary Examiner*—Stanley H. Tollberg

*Attorney, Agent, or Firm*—Frank H. Marks

[57] ABSTRACT

A napkin dispenser designed primarily for disposition on a restaurant table or counter and normally housing a stack of paper napkins. The dispenser is in the form of a parallelopiped with a top access opening for loading and removing napkins. The opening is generally rectangular or may taper slightly from one end ot the other. An important feature is that the edges of the opening extend outwardly, providing a relatively narrow peripheral arcuate flange or lip around the opening, the effect of which is lead a napkin gently outwardly without likelihood of damage to the exiting napkin. My improved construction more or less insures extraction of a single napkin at a time, inhibiting vandalism and results in substantial economy of construction and operation. Another improved feature is a novel follower arrangement including a coil spring for urging the napkins toward the egress opening and designed to insure that the coil spring is maintained in proper axial alignment for maximum efficiency.

3 Claims, 9 Drawing Figures

NAPKIN DISPENSER

This application is in part a continuation of my copending application Ser. No. 76,830 filed Sept. 19, 1979, now abandoned.

My invention relates to dispensers for paper napkins of the type usually found on restaurant tables or counters for self service by patrons.

BACKGROUND

This invention may be considered an improvement over that disclosed and claimed in my U.S. Pat. No. 4,094,442 granted June 13, 1978. That patent and the citations therein probably constitute the art most pertinent to the present invention.

Like this invention, my prior patent had to do with inhibiting vandalism prevalent in many self-service establishments, particularly in the deliberate extraction from a dispenser and wastage of a plurality of napkins in a single handful, as well as accidental damage to napkins in the course of extraction from the holder. My prior invention solved this problem satisfactorily, a major feature thereof consisting of a pair of hinged leaves on opposite sides of the extraction opening.

BRIEF OUTLINE OF INVENTION

The present invention constitutes a marked improvement over the aforesaid patent, particularly in regard to cost of production, while accomplishing the objectives at least as well as the former invention.

The hinged leaves previously considered essential are now eliminated, resulting in substantial simplification and reduced cost of fabrication.

I find that I can accomplish substantially the desired result by providing a generally rectangular or slightly tapered extraction opening with outwardly extending marginal flanges or lips, rounded in cross section to provide minimum resistance to napkin extraction.

Another object is to provide a new and improved follower contributing materially to extraction of napkins without damage and inhibiting vandalism.

Various other objects and advantages will become apparent to those skilled in the art as the description proceeds.

BRIEF DESCRIPTION OF DRAWINGS

Referring now to the drawings forming part of this specification and illustrating certain preferred embodiments of my invention.

DETAILED DESCRIPTION

Figure 1:
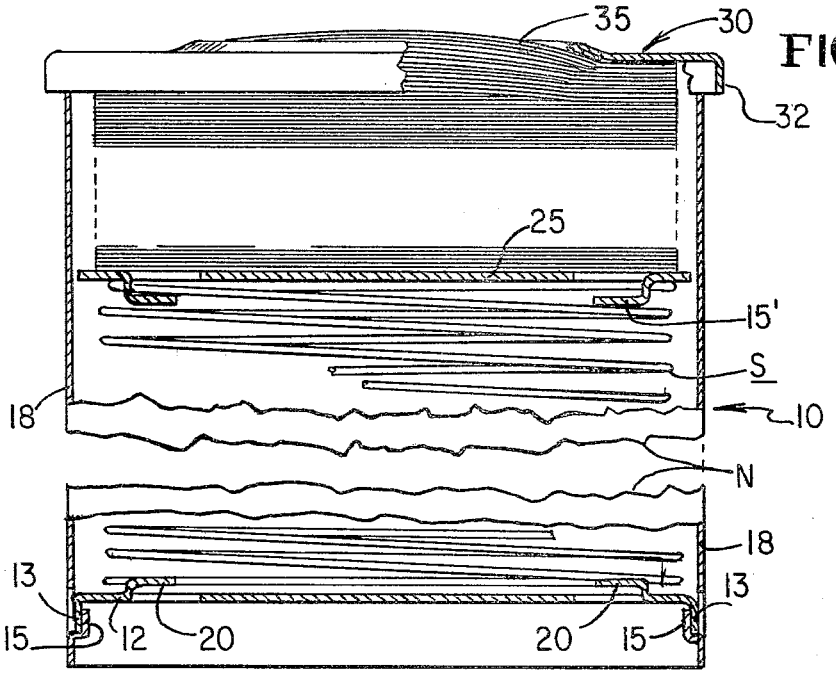
FIG. 1 is a fragmentary vertical section, partly in elevation, of a napkin dispenser embodying my invention.

In general, except for the end plate to be described and an improved follower, my improved construction may be substantially similar to that of my prior patent in that it consists of a box-like container 10, preferably in the form of a rectangular parallelopiped that may be of sheet metal, preferably of stainless steel, or other suitable material with dimensions appropriate to house a stack of folded paper napkins N.

The container is closed at one end, as by a plate 12 peripherally flanged as at 13 to seat in lugs 15 struck out from side walls 18. Wall 12 is provided with ears 20 struck out to retain the end convolution of a helical spring S urging a follower plate 25 against the stack of napkins. Lugs or ears 15' are also struck out from follower 25 to engage the opposite terminal convolution of spring S.

Figure 2:
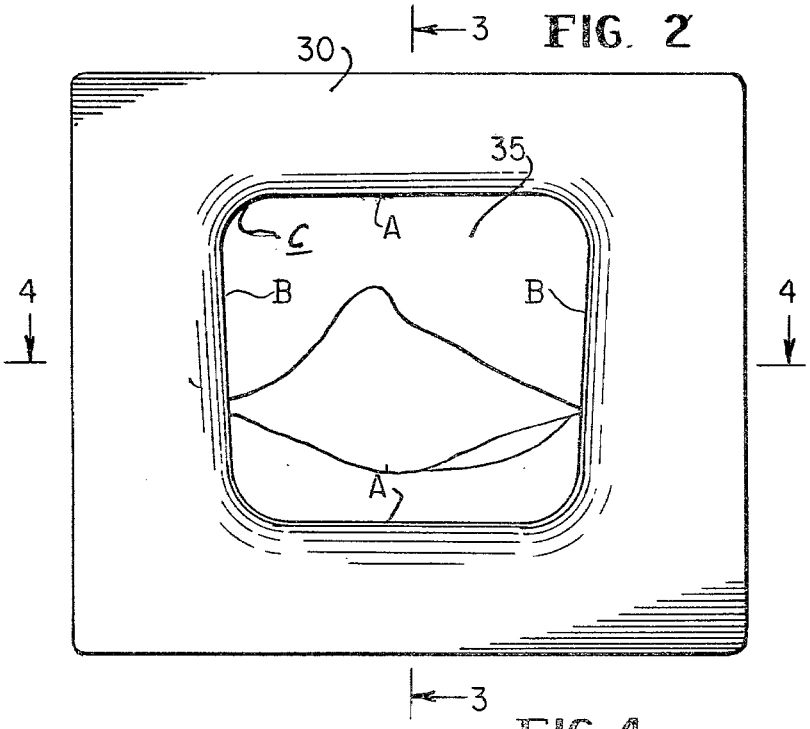
FIG. 2 is a top plan view of the same.
Figure 3:
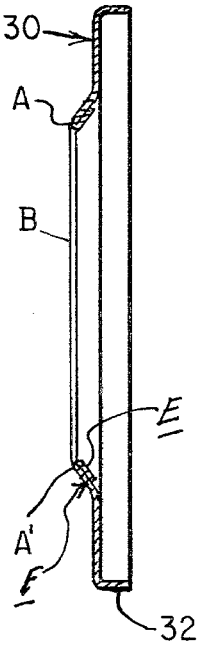
FIG. 3 is a sectional view taken substantially along line 3—3 of FIG. 2.
Figure 4:
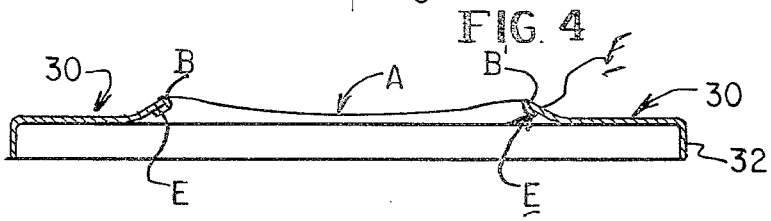
FIG. 4 is a sectional view along line 4—4 of FIG. 2.

Referring now to FIGS. 2–4, inclusive, I provide an end plate 30 for ingress-egress of napkins, said plate formed with a peripheral or marginal flange 32 seated over side walls 18 and having a dispensing opening 35 therein with rounded corners C. It will be noted from FIG. 2 that opening 35 preferably tapers slightly inwardly from top to bottom, side A being slightly longer than side A'.

Referring to FIGS. 3 and 4, it will be noted that the four edges A, A', B and B' extend obliquely outwardly to provide a marginal flange all around, the free edges of said flanges being reversely turned inwardly to provide a terminal flange E.

Said flange E provides an especially smooth edge surface, greatly reducing friction as a napkin is drawn past said surfaces in the course of extraction.

Figure 5:
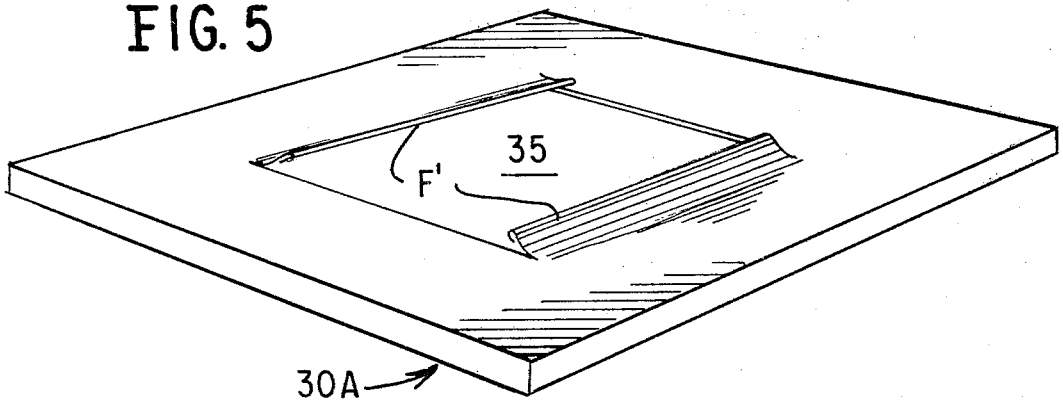
FIG. 5 is a perspective view of an end plate with ingress-egress opening in a modified construction.
Figure 6:
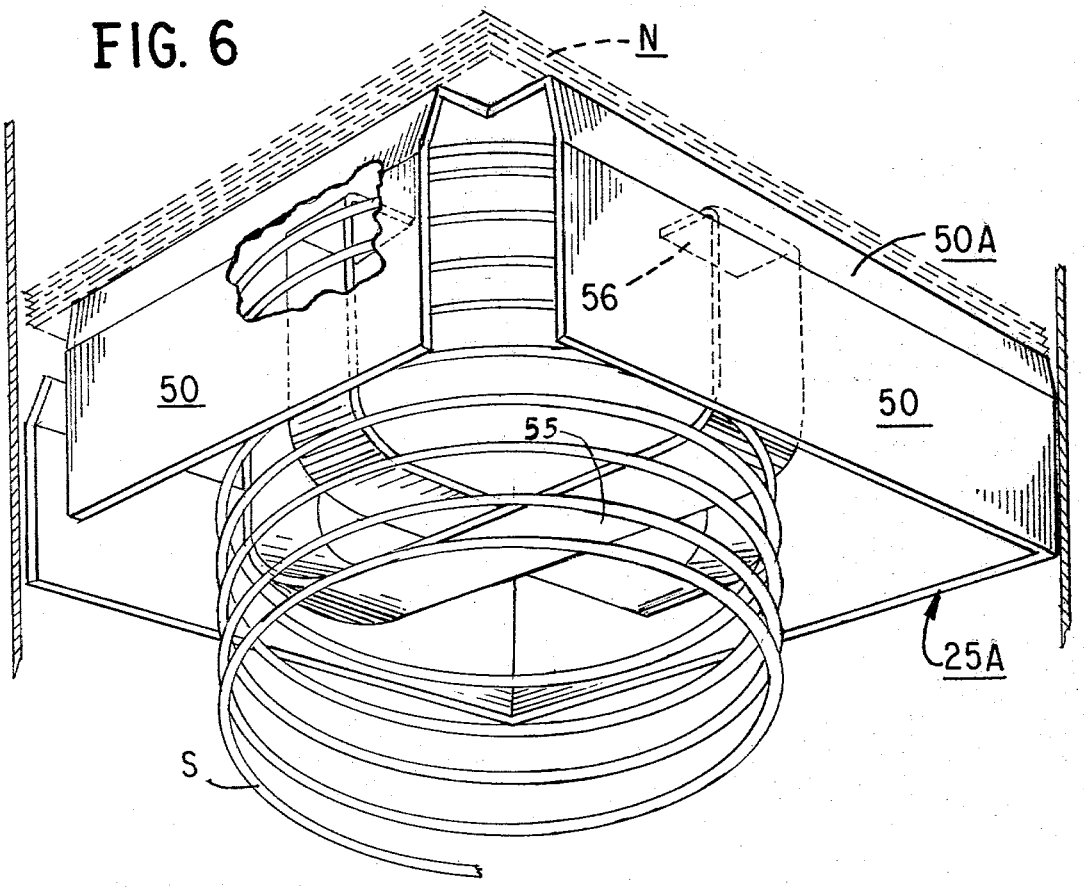
FIG. 6 is a perspective view of a modified follower and associated parts.
Figure 7:
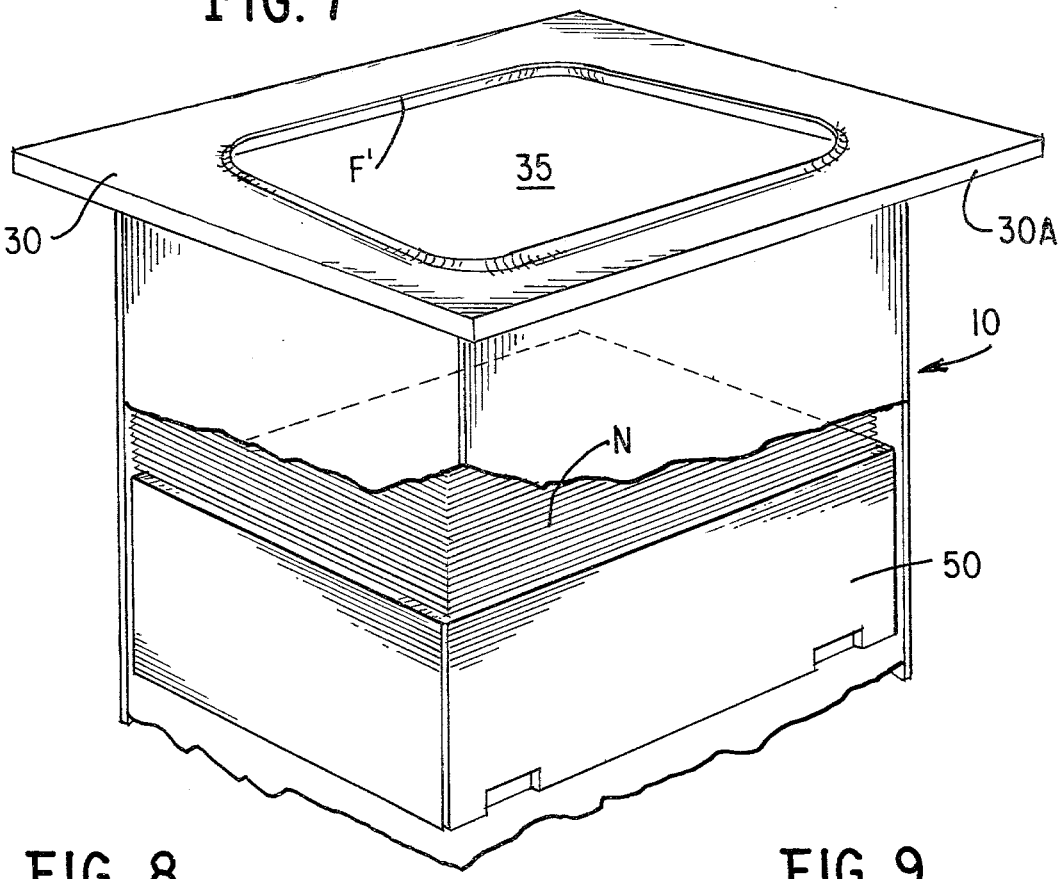
FIG. 7 is a fragmentary perspective showing the follower of FIG. 6 assembled with the dispenser.
Figure 8:
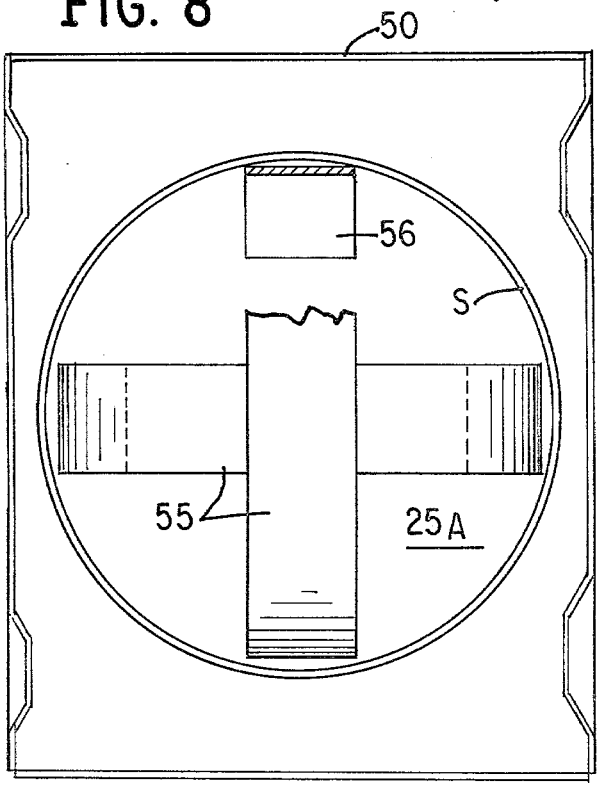
FIG. 8 is a bottom plan view of the follower of FIG. 7.
Figure 9:
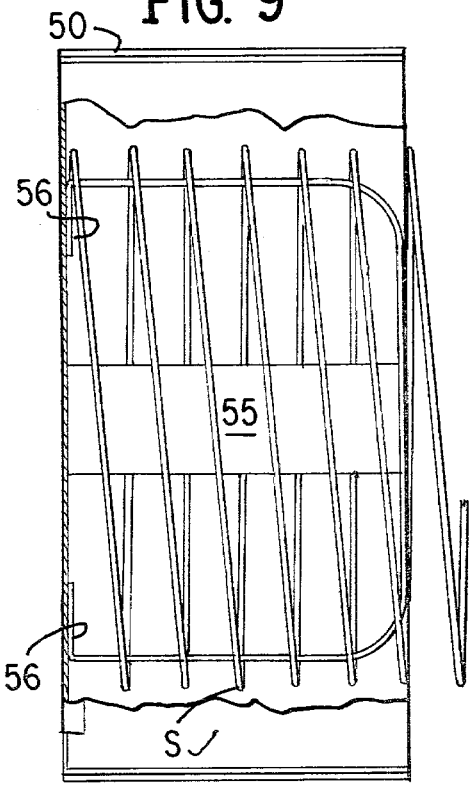
FIG. 9 is a section/elevation of the follower of FIG. 8.

As seen in the modified form of FIG. 5, cover plate 30A may be provided with flanges F' similar to flanges F on only two sides of opening 30 instead of all four sides, said flanges F' being on the lateral margins of opening 35.

Also, as seen in FIG. 2, when container 10 is loaded with a stack of folded napkins, the free folded edges normally extend parallel to edges A and A' of opening 35. A napkin may most conveniently be extracted by grasping a free edge nearer edge A' and urging the napkin outwardly toward edge A. As extraction continues, the napkin will gradually be extricated as it approaches the opposite edge of the opening. At this stage of the extraction process the next napkin is the stack becomes available for extraction.

FIGS. 6–9 show a modified and improved napkin follower 25A which operates with great efficiency to maintain, in conjunction with spring S, the stack of napkins firmly in position against opening 35.

Follower 25A comprises a rectangular plate member of generally the same dimensions as the folded plies of napkins, from which plate member integral marginal flanges 50 extend generally normally to provide a sort of cup seating an end convolution of a coil spring S. Flanges 50 may be bent directly at right angles from the end plate, as in FIGS. 7–9, or may have an intermediate diagonal flange 50A intermediate flanges 50 and the end plate (seen in FIG. 6).

To aid in holding spring S in proper position and prevent wobbling thereof, I provide a rectangular spider 55 of crossed U-bars (two will suffice), spring S being seated sungly between the spider legs and flanges 50.

Each of U-bars of spider 55 is affixed to the underside of the rectangular plate 25A by means of terminal flanges 56, extending generally normally therefrom generally parallel to flanges 50 of the cup member, then bent normally to provide crossing web portions generally parallel to the follower plate contiguous to the napkin stack. Thus, the crossed U-bars of the spider provide space only slightly more than sufficient to seat helical spring S between the spider and flanges 50. Accordingly, the combination of the spider and cup-like member effectively maintain the spring in proper axial position, preventing wobble thereof, and thus assure even pressure against the stack of napkins and guarantee extraction of them, one at a time, without damage.

CONCLUSION

It will be seen that dispensers embodying my invention operate in a highly satisfactory manner to assure efficient extraction of napkins singly and without waste or damage.

Because of enhanced simplification of design, without movable parts, my new dispenser may be produced at substantially reduced cost as compared with previosly known dispensers.

Various other changes may suggest themselves to those skilled in the art without departing from the spirit of my invention. Hence, I do not wish to be restricted to the specific forms shown or uses mentioned, except to the extent indicated by the appended claims.

I claim:

1. A dispenser for paper napkins arranged in a stack, each napkin folded in multiple plies having a final rectangular contour with the outermost lifting ply terminating in a straight edge extending across the width of the folded napkin along a line parallel to the top and bottom edges thereof, comprising (a) a rectangular parallelopiped container having a rectangular end wall of the approximate dimensions of said folded napkins and four side walls fixed to said end wall, (b) an ingress-egress wall secured to the side walls opposite said end wall and having a generally rectangular opening therein for loading and dispensing napkins into and out of said container, said opening having marginal edges, (c) the edges of said opening in said ingress-egress wall being turned to form a smooth peripheral flange encompassing said opening, to facilitate egress of a napkin without damage thereto, (d) means inside said container for resiliently urging napkins toward said opening, comprising a cup-like follower having a planar surface for supporting a stack of napkins, with marginal flanges extending generally normally from the edges of said surface and dimensioned to be slideable within the side walls of said container, (e) a spider disposed within said follower comprising a pair of U-bars having end portions crossing each other and opposed portions at the opposite ends secured to the underside of said planar surface, and leg portions extending between said opposed end portions and defining relatively limited spaces between them and the marginal flanges of the follower, and (f) a helical spring extending from the end wall of said container to said follower with a plurality of the turns at the movable end of said spring disposed within said spaces between the legs of said spider and marginal flanges, to serve as a stabilizing guide for said movable end of said spring, the follower and spring being otherwise unconnected.

2. A napkin dispenser as in claim 1, wherein the leg portions of the U-shaped bars are in close proximity to a plurality of the coils of the spring at four equidistantly displaced portions, to provide controlled axial movement of the follower in the direction of the spring's force.

3. A paper napkin dispenser comprising a container in the form of a rectangular parallelopiped, with cross-sectional dimensions enabling the container to receive a folded stack of napkins, said container having side walls, a closed end wall and an opposed open end access wall, and a follower inside said receptacle comprising (a) a cup-like member dimensioned to be slideable in the receptacle and comprising a plate portion designed to abut the back side of the napkin stack and integral side members extending generally normally from said plate portion, (b) a spider comprising crossed legs secured to said plate portion on the side opposite said stack, said legs having guide portions spaced closely from the inner faces of said side members, and (c) a helical spring extending between said closed end wall and cup-like member and of a cross-section occupying the major cross-section of the latter but free of connection thereto, and disposed between said spider legs and said members to maintain the convolutions of the spring in proper axial position and said plate portion in its proper position abutting the stack, thus tending to deter excessive napkin removal.

* * * * *